United States Patent [19]

Leone et al.

[11] Patent Number: 4,926,019

[45] Date of Patent: May 15, 1990

[54] MOVING COPPER PIVOT

[75] Inventors: David A. Leone; Clifford A. Buxton, both of Lawrenceville; James A. Tharp, Conyers; Neil A. McCord, Lawrenceville, all of Ga.

[73] Assignee: Siemens Energy & Automation, Inc., Atlanta, Ga.

[21] Appl. No.: 242,233

[22] Filed: Sep. 8, 1988

[51] Int. Cl.[5] ..... H01H 33/18

[52] U.S. Cl. ..... 200/147 R; 200/144 R; 200/146 R; 200/245; 200/250; 200/257; 200/272; 200/274

[58] Field of Search ..... 200/146 R, 252, 253, 200/257, 259, 273, 274, 275, 283, 291, 144 R, 147 R

[56] References Cited

U.S. PATENT DOCUMENTS

| | | | |
|---|---|---|---|
| 3,215,803 | 11/1965 | Goodwin, Jr. | 200/146 R |
| 3,264,442 | 8/1966 | Holzer | 200/166 |
| 3,271,533 | 9/1966 | Butler | 200/257 |
| 3,365,561 | 1/1968 | Jencks et al. | 200/166 |
| 3,735,075 | 5/1973 | Kidd | 200/146 R |
| 4,137,437 | 1/1979 | Maier et al. | 200/153 SC |
| 4,166,205 | 8/1979 | Maier et al. | 200/153 R |
| 4,219,713 | 8/1980 | Maier et al. | 200/153 R |
| 4,245,203 | 1/1981 | Wafer et al. | 335/16 |
| 4,264,796 | 4/1981 | Nelson et al. | 200/153 SC |
| 4,291,209 | 9/1981 | Seidling et al. | 200/153 G |
| 4,319,104 | 3/1982 | Decroix et al. | 200/147 R |
| 4,484,164 | 11/1984 | McClellan et al. | 335/16 |
| 4,524,339 | 6/1985 | Chabot | 335/22 |
| 4,554,427 | 11/1985 | Flick et al. | 200/250 |
| 4,598,186 | 7/1986 | Cook et al. | 200/144 R |
| 4,635,012 | 1/1987 | Kohanawa et al. | 335/16 |
| 4,713,504 | 12/1987 | Maier | 200/146 R |

*Primary Examiner*—Robert S. Macon

*Attorney, Agent, or Firm*—James G. Morrow; Lawrence C. Edelman

[57] ABSTRACT

A pivoting electrical connected useable in a molded case circuit breaker including a pair of contact plates for contacting the circular contact member of a contact carrying arm. The pivoting electrical connection provides at least three contact locations between the contact plates and the circular contact member. The contact locations provide current paths between a first terminal coupled to the contact plates and an electrical contact fixed to the contact carrying arm. The pivoting electrical connection allows the contact on the arm and an electrical contact coupled to a second terminal to be opened and closed.

13 Claims, 7 Drawing Sheets

MOVING COPPER PIVOT

BACKGROUND OF THE INVENTION

This invention relates to a pivoting electrical connection, and more particularly to a low resistance pivoting electrical connection adapted to carry high load currents.

Many forms of power switching apparatus, such as circuit breakers, require a pivoting or rotatable electrical connection to facilitate the separation of electrical contacts in the apparatus. One of the main problems with a pivoting electrical connection is the electrical resistance present at the interface between the operative elements of the connection. When a load current flows through the electrical connection, heating occurs at the interface due to the electrical resistance. Depending on the size of the required load current, it can be difficult to provide a pivoting electrical contact which does not experience a prohibitively high rate of heating at the interface. The patents discussed below illustrate different types of pivoting connections.

U.S. Pat. Nos. 4,137,437, 4,166,205, 4,219,713, 4,264,796, 4,291,209, 4,635,012, and 4,524,339 illustrate pivoting electrical connections useable in circuit breakers. U.S. Pat. Nos. 4,137,437 4,166,205, 4,219,713, 4,264,796, 4,291,209, illustrate a movable contact having a circular segment sized to engage a circular sigment which is part of a stationary contact. U.S. Pat. No. 4,635,012 illustrates a circuit breaker contactor having a structure in which a connecting conductor is bifurcated into two legs by providing a slit in the longitudinal direction, and arc-like receptor surfaces slidably supporting the circular sliding contact surface of one end of a movable contactor. U.S. Pat. No. 4,524,339 illustrates a blade pivot assembly for a circuit breaker which includes a spring wrapped about each circular blade boss providing multiple points of electrical contact between each blade and a bearing boss.

While the above-discussed patents provide various configurations for pivoting connections it is clear that it would be advantageous to provide other pivoting connection configurations which have a low electrical resistance, a low manufacturing cost, and high reliability.

SUMMARY OF THE INVENTION

Accordingly, the present invention provides for a current carrying pivot for a circuit breaker comprising a contact member and a substantially circular contact member rotatably coupled with the contact member. The members cooperate to form at least three contact locations for carrying current. An object of this invention is to provide a low cost and low resistance current carrying pivot.

The present invention has the advantage of providing a pivoting electrical contact having more than two contact locations. The present invention has an additional advantage of providing a variable pressure pivoting electrical contact. The invention also has the advantage of being inexpensive to manufacture and assemble.

Various other objects and advantages of the present invention will become apparent from the following description, with reference to the accompanying drawings.

DETAILED DESCRIPTION OF THE PREFERRED EMBODIMENT

Figure 1:
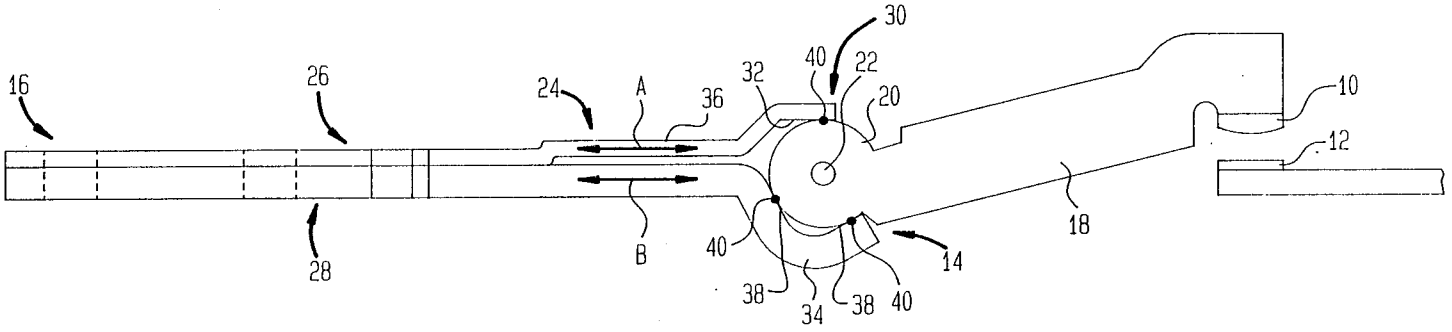
FIG. 1 is a side view of the current carrying pivot.

Turning now to the drawings, FIG. 1 illustrates a current path for a circuit breaker such as a molded case circuit breaker. For opening and closing the contacts 10, 12 there is provided a pivoting connection 14 which provides a current path between the contact 10 and a terminal 16. In the preferred embodiment of the connection, a contact arm 18, which includes a circular contact portion 20, rotates about an axis 22 when the contacts 10, 12 are opened and closed. A contact assembly 24 cooperates with the circular contact portion 20 to complete the current path from the terminal 16 to the contact arm 18.

Figure 2:
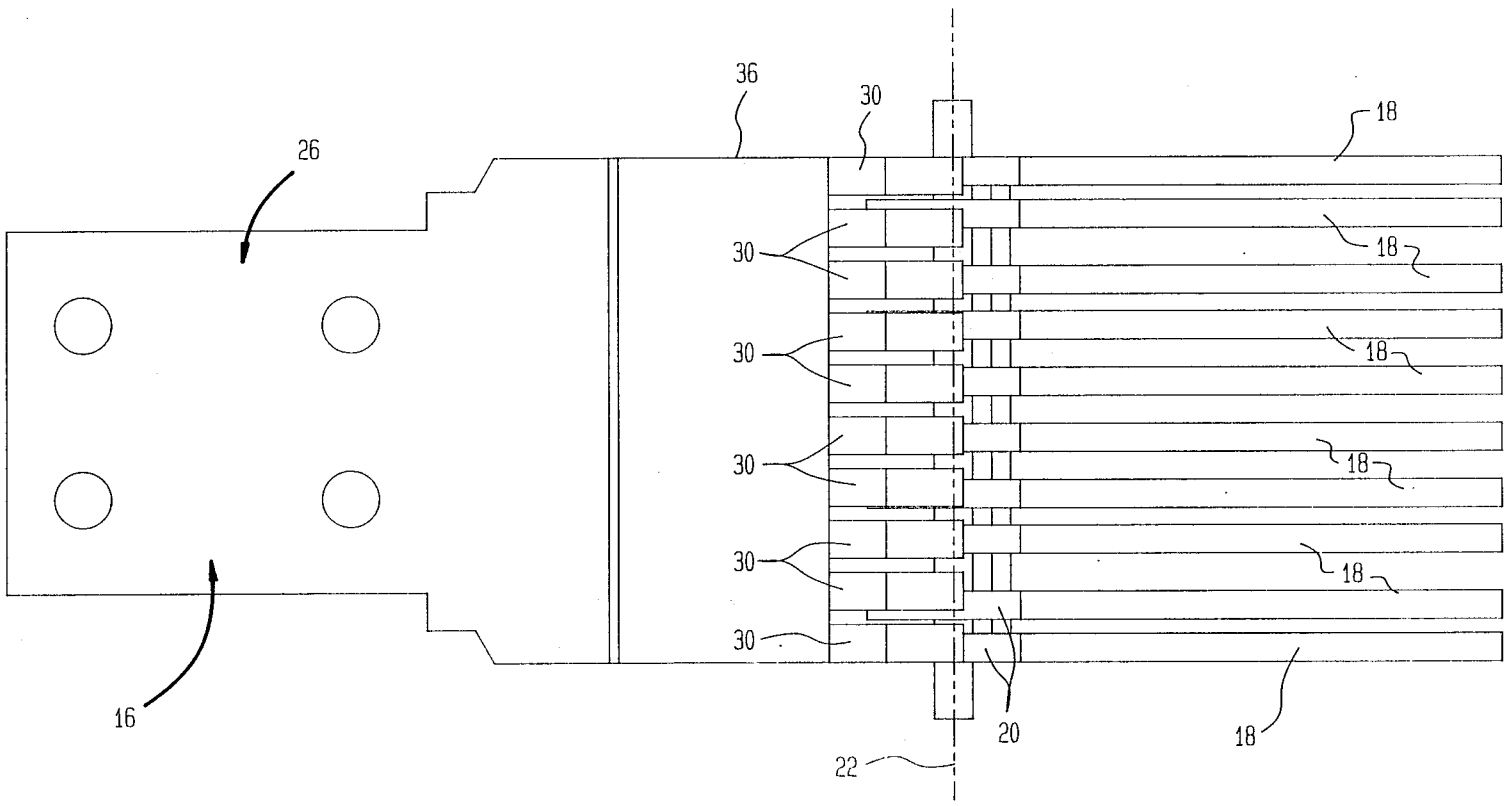
FIG. 2 is a top view of the current carrying pivot.

The contact assembly 24 includes two contact plates 26, 28 which engage the circular contact portion 20. The contact plate 26 includes one or more end portions 30 having a flat surface 32 for contacting the circular contact portion 20 at its periphery. The contact plate 28 includes an end portion 34 having two flat surfaces 38 for contacting the circular contact portion 20 at its periphery. Accordingly, three contact locations 40 are provided to produce current paths between the contact plates 26, 28 and the contact arm 18. FIG. 2 is a top view of the contact plates 26, 28 contacting ten circular contact portions 20.

For the preferred embodiment of the contact plates 26, 28, the lower contact plate 28 is fabricated such that it is more rigid than the upper contact plate 26. The rigidity of the lower contact plate 28 functions to maintain the axis 22 in the given location when the contact arm 18 is under load. The upper contact plate 26 is fabricated such that it includes a cantilever portion 36. The cantilever portion 36 provides a means for allowing the contact pressure between the flat surfaces 32, 38 and the circular contact portion 20 to increase when the load current of the circuit breaker passes through the current path. The pressure increase is produced by the interaction of the currents in current paths A and B and the associated magnetic fields produced by these currents.

Figure 3:
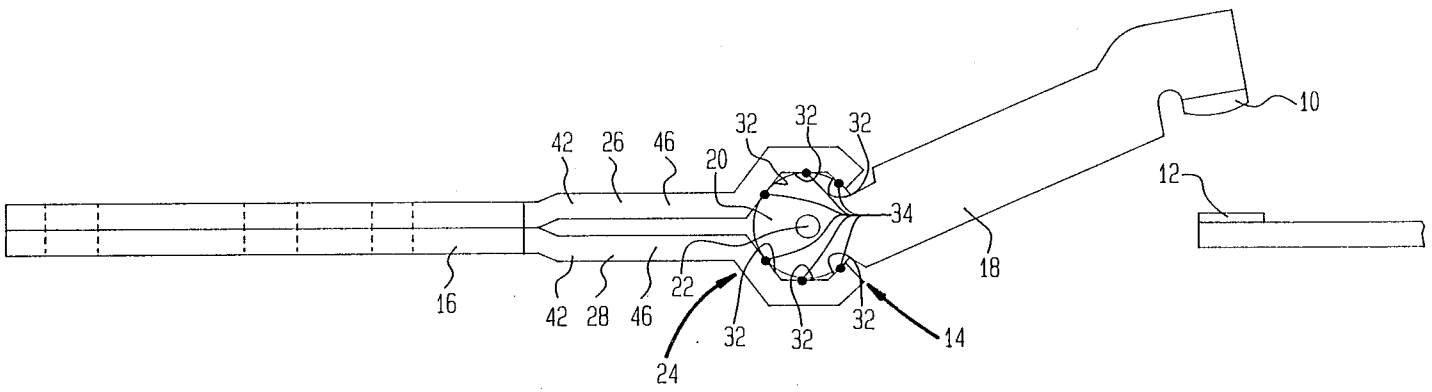
FIG. 3 illustrates a second embodiment of the pivot.
Figure 4:
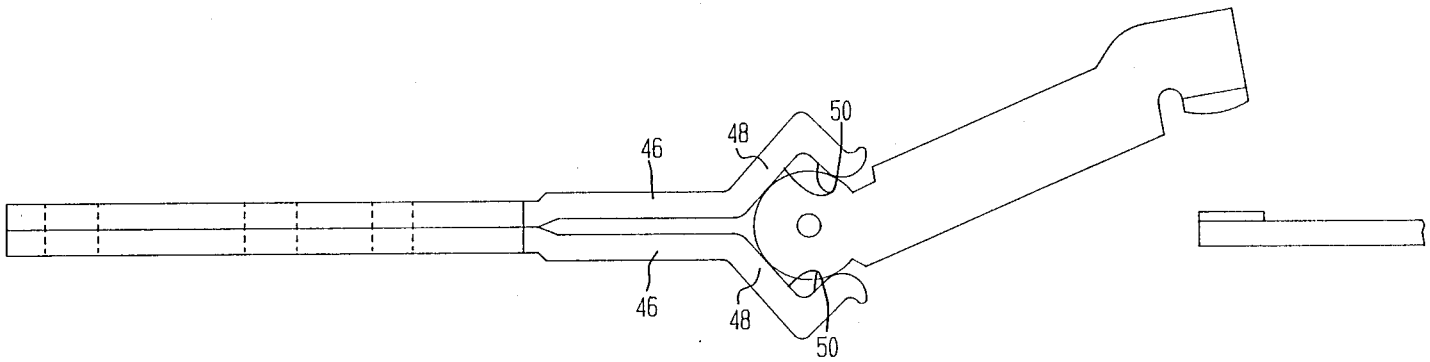
FIG. 4 illustrates a third embodiment of the pivot.
Figure 5:
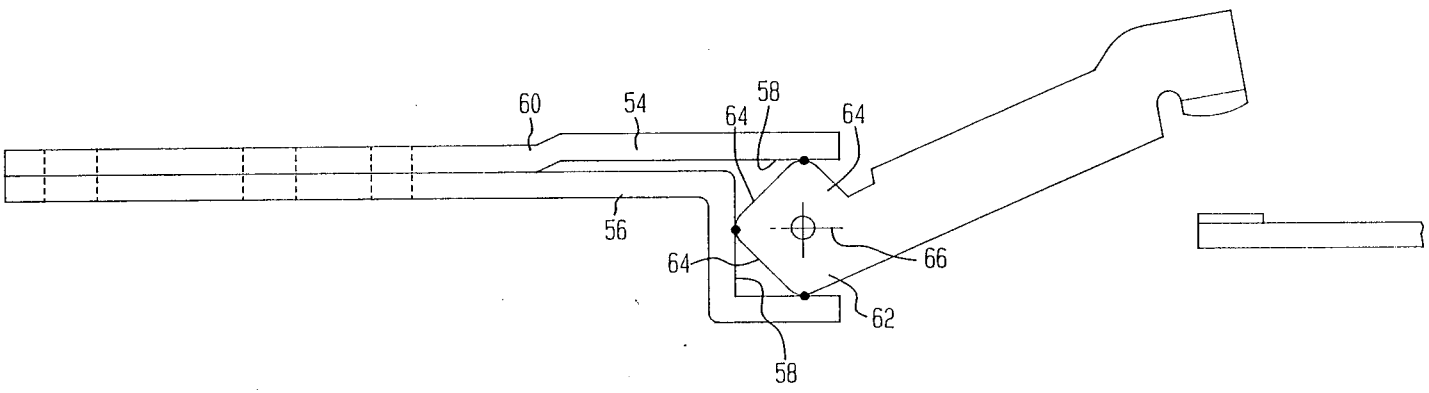
FIG. 5 illustrates a fourth embodiment of the pivot.

FIGS. 3–5 illustrate 3 other contact plate configurations. The contact plates 42 illustrated in FIG. 3 each include three flat surfaces 32, two of which contact a circular contact 20. The plates 42 also include a cantilever portion 46. The contact plates 48 illustrated in FIG. 4, each include two flat surfaces 50 for contacting a circular contact and a cantilever portion 46. For the configurations of FIGS. 3 and 4, four contact locations can be provided to produce current paths between the contact plates and the contact arm 18.

FIG. 5 illustrates a contact plate configuration employing different contact plates 54 and 56. One of the contact plates 54 includes cantilever portion 60 and one flat surface 58 at its end portion, while the other contact plate 56 includes two flat surfaces 58 at its end portion. The flat surfaces 58 cooperate with the contact 62 having three flattened sides 64 to provide three current paths. The geometry of the contact 62 is such that when the contact 62 is caused to rotate about the axis 66, the contact 62 pressure between the plates 54, 56 and contact 62 varies. Accordingly, the contact 62 could also have a cam-type configuration.

Figure 6:
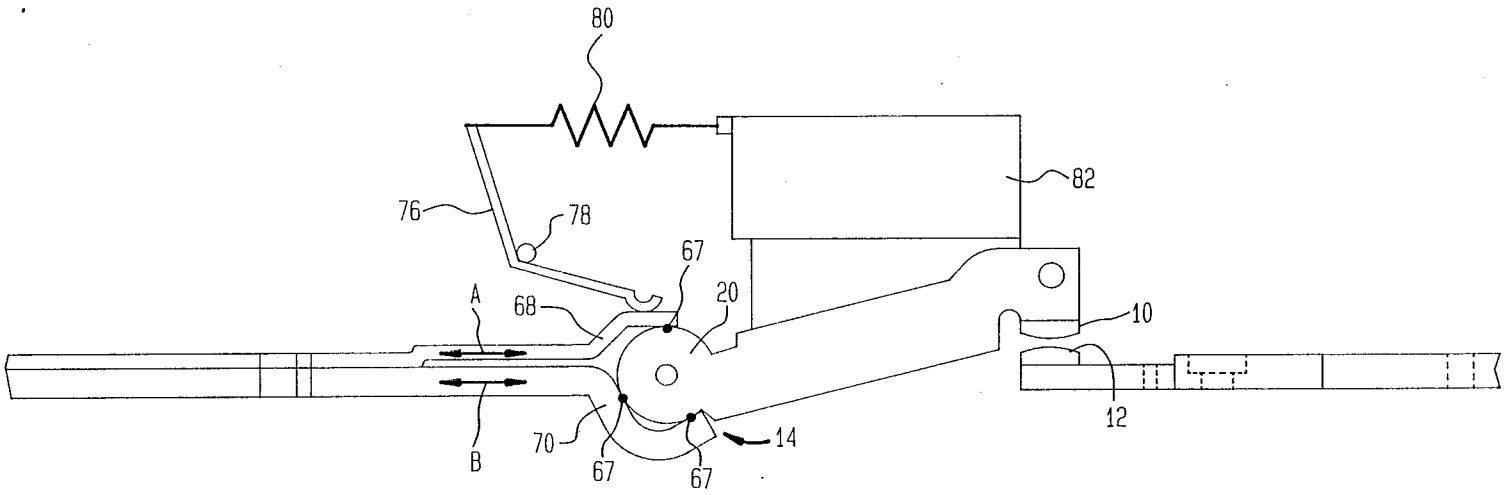
FIG. 6 illustrates a fifth embodiment of the pivot.
Figure 7:
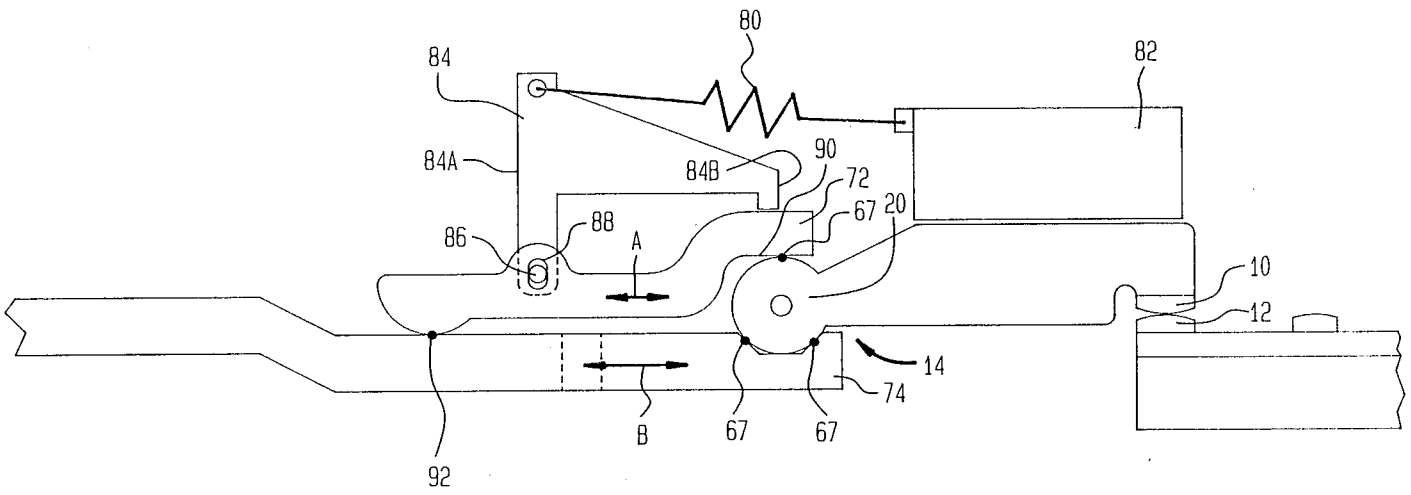
FIG. 7 illustrates a sixth embodiment of the pivot.

FIGS. 6 and 7 illustrate two modifications to the pivoting connection 14 which increases the contact pressure at the points of contact 67 between the contact portion 20 and the contact members 68, 70, 72, 74. In particular, the modifications are adapted to increase the contact pressure when the contacts 10, 12 are closed and relieve the contact pressure when the contacts 10, 12 are opened. Increasing the contact pressure while the contacts 10, 12 are closed reduces the electrical resistance of the connection 14 and increases the current carrying capacity of the connection 14. In addition, by increasing the contact pressure as the contacts 10, 12 close, the amount of energy required to close the contacts 10, 12 is reduced. Relieving the contact pressure when the contacts 10, 12 are opened reduces the friction in the connection 14 and, accordingly, allows the contact 10, 12 to be separated with more speed. The modification is also adapted to assist the pressure increase caused by the interaction of the currents in current paths A and B as discussed above.

Referring now to FIG. 6, a leaf spring member 76 rides upon the contact member 68 and is pivoted about a pivot 78. A conventional actuator crossbar 32 (as shown schematically) employed in the manner well known in the art to controllably open contacts 10, 12. The top end of the member 76 is connected to a spring 80, the other end of which is also connected to the crossbar 82 shown schematically). Based upon the geometrical relationship of the member 76, spring 80, crossbar 82 and connection 14, it can be seen that the tension in the spring 80 increases when the contacts 10, 12 are closed and decreases when crossbar 82 opens the contacts 10, 12 in the conventional manner. Accordingly, the member 76 causes the contact pressure in the connection 14 to increase when the contacts 10, 12 are closed and decreases when the contacts 10, 12 are opened.

Referring to FIG. 7, a pivot member 84 having a leg portion **84*a* and traverse foot portion 84*b*, rides upon the contact member 72 (i.e. foot portion 84*b* rides upon member 72, overlying contact portion 20) and is pivoted one end of the leg portion 84*a* about the pivot 86. The other end of leg portion 84*b* is connected to the spring 80, wherein the spring 80 is also connected to the conventional crossbar 82 (shown schematically). The member 72 includes a slot 88 which follows the pivot 86 and allows the surface 90 to contact the portion 20 while the member 72 pivots about the point 92. As previously noted, the interaction of the currents in current paths A and B and the associated magnetic fields produced by the currents, cause members 72 and 74 to be pressed together and biased against contact position 20**.

Based upon the geometrical relationship of the member 84, spring 80, crossbar 82, member 72 and connection 14, it can be seen that the tension in the spring 80 increases when the contacts 10, 12 are closed and decreases when the contacts 10, 12 are opened. Accordingly, the member 84 causes the contact pressure in the connection 14 to increase when the contacts 10, 12 are closed (i.e. as is apparent from FIG. 7, the tension of spring 80 causes member 84 to rotate about pivot 86 such that foot **84*b* is biased against contact member 72.) and decreases when the contacts 10, 12 are opened. The tension of spring 80 is relieved by the concomitant movement of conventional actuation crossbar 82**.

While five embodiments of a current carrying pivot and several modifications thereof have been shown and described in detail herein, various other changes and modifications may be made without departing from the scope of the present invention. For example, the flat surfaces of the contact plates could be integrated with the contact arm such that the circular contact remains stationary during contact opening and closing.

We claim:

1. A current carrying pivot for a circuit breaker comprising:

a contact comprising, a terminal, a first contact portion defining at least one substantially flat contact surface, and a second contact portion defining at least two substantially flat contact surfaces; and a substantially circular contact member including a contact portion rotatable about an axis, the member being rotatably coupled with said contact, disposed to cooperate with the first and second contact portions to form at least three contact locations for carrying current and the axis is disposed between the first contact portion and the second contact portion.

2. A current carrying pivot for coupling an electrical contact with a terminal of a circuit breaker comprising:

a first contact ember defining at least one substantially flat contact surface;

a second contact member defining at least two substantially flat contact surfaces; and a contact supporting member integral with a substantially circular contact portion rotatably contacting the first and second contact members, wherein the members cooperate to form at least three contact locations for carrying current.

3. The current carrying pivot of claim 2 wherein the first contact member each defines a cantilever portion.

4. The current carrying pivot of claim 2 wherein the first and second contact members each define a cantilever portion.

5. The current carrying pivot of claim 2 wherein the circular contact member includes an electrical contact and the contact members include a terminal.

6. A connection for coupling an electrical contact with a terminal of a circuit breaker comprising:

a first contact member defining a cantilever portion and at least one substantially flat contact surface;

a second contact member defining at least one substantially flat contact surface; and a plurality of substantially circular contact members rotatably coupled with the contact members, wherein the circular members cooperate with the contact members to form at least two contact locations adapted to carry current.

7. The connection of claim 6 wherein the second contact member further defines a cantilever portion.

8. The connection of claim 6 wherein the circular contact member includes an electrical contact and the contact members include a terminal.

9. A currant carrying pivot for coupling a first electrical contact with a terminal of a circuit breaker comprising:

a first contact member defining at least one substantially flat contact surface;

a second contact member defining at least two substantially flat contact surfaces;

a substantially circular contact member rotatable about an axis and rotatably coupled with the first and second contact members, wherein the members cooperate to form at least three contact locations for carrying current and the axis is located between the first contact member and the second contact member; and means for increasing contact pressure between the contact members and the substantially circular contact member.

10. The apparatus of claim 9 wherein the means for increasing contact pressure comprises:

a pivotally mounted substantially rigid member for contacting the first contact member; and a spring adapted to urge the rigid member against the first contact member, wherein the first contact member is pivotally mounted.

11. The pivot of claim 9 wherein said means for increasing contact pressure between said contact members and said substantially circular contact member comprises:

a first terminal portion and a first cantilever portion integrally formed in said first contact member, said first cantilever portion culminating in a first end portion including said first contact member contact surface;

a second terminal portion and a second cantilever portion integrally formed in said second contact member, said second cantilever portion culminating in a second end portion including said second contact member contact surface; whereby current flowing through said first and second contact members and the magnetic fields produced thereby cause said first and second cantilevered portions to be attracted to each other, biasing said contact member contact surfaces against the periphery of said substantially circular contact member.

12. In a circuit breaker, a pivotable connection for carrying current, said pivotable connection comprising:

first and second contact members; and a pivotable contact arm;

said pivotable contact arm including a curved contact portion of predetermined configuration;

said first contact member including a terminal portion and an integral cantilever portion culminating in an end portion having at least one discrete contact surface;

said second contact member including a terminal portion and an integral cantilever portion culminating in an end portion having at least two discrete contact surfaces in transverse relative dispostion;

said first and second contact members being disposed with the terminal portions thereof in electrical contact and said cantilever portion spaced apart with the end portions in opposition;

said pivotable contact arm contact portion being disposed between said opposed end portions in peripheral contact with said contact surfaces for rotation about a predetermined axis;

whereby current flowing through said first and second contact members and the magnetic fields produced thereby cause said cantilevered portions to be attracted to each other, biasing said contact member contact surfaces against the periphery of said contact arm contact portion.

13. A current carrying pivot for coupling a first electrical contact with a terminal of a circuit breaker comprising:

a first contact member defining at least one substantially flat contact surface;

a second contact member defining at least two substantially flat contact surfaces;

a substantially circular contact member rotatably coupled with the first and second contact member, wherein the members cooperate to form at least three contact locations for carrying current; and means for increasing contact pressure between the contact members and the substantially circular contact member comprising a pivotally mounted leaf spring member for contacting the first contact member, and a spring adapted to urge the leaf spring member against the first contact member.

* * * * *